US011124710B2

(12) United States Patent
Philoon et al.

(10) Patent No.: US 11,124,710 B2
(45) Date of Patent: Sep. 21, 2021

(54) NAPHTHA HYDROTREATING PROCESS WITH SULFUR GUARD BED HAVING CONTROLLED BYPASS FLOW

(71) Applicant: UOP LLC, Des Plaines, IL (US)

(72) Inventors: Steven B. Philoon, Wilmette, IL (US); Patrick J. Bullen, Elmhurst, IL (US); Stanley J. Frey, Palatine, IL (US); Gail L. Gray, Lisle, IL (US); Dean E. Rende, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 107 days.

(21) Appl. No.: 16/545,709

(22) Filed: Aug. 20, 2019

(65) Prior Publication Data

US 2021/0054295 A1 Feb. 25, 2021

(51) Int. Cl.

| | |
|---|---|
| ***C10G 25/00*** | (2006.01) |
| ***C10G 25/05*** | (2006.01) |
| ***C10G 45/10*** | (2006.01) |
| ***C10G 45/12*** | (2006.01) |
| ***C10G 35/06*** | (2006.01) |
| ***C10G 69/08*** | (2006.01) |
| ***C10G 7/00*** | (2006.01) |

(52) U.S. Cl.

CPC ..... *C10G 25/05* (2013.01); *C10G 7/00* (2013.01); *C10G 35/06* (2013.01); *C10G 45/10* (2013.01); *C10G 45/12* (2013.01); *C10G 69/08* (2013.01); *C10G 2300/104* (2013.01); *C10G 2300/1044* (2013.01); *C10G 2300/202* (2013.01)

(58) Field of Classification Search

CPC ..... C10G 25/05; C10G 27/00; C10G 35/04; C10G 35/06; C10G 45/02; C10G 45/10; C10G 45/12; C10G 65/04; C10G 69/02; C10G 69/08; C10G 2300/104; C10G 2300/1044; C10G 2300/202

See application file for complete search history.

(56) References Cited

U.S. PATENT DOCUMENTS

| | | | | |
|---|---|---|---|---|
| 4,929,794 | A | 5/1990 | Schmidt et al. | |
| 5,246,567 | A | 9/1993 | Buttke et al. | |
| 7,799,210 | B2 | 9/2010 | Dysard et al. | |
| 2005/0284794 | A1 * | 12/2005 | Davis | C10G 65/12 208/89 |

FOREIGN PATENT DOCUMENTS

| | | | |
|---|---|---|---|
| WO | 0159032 | A1 | 8/2001 |

OTHER PUBLICATIONS

International Search Report from corresponding PCT application No. PCT/US2020/046283, dated Nov. 5, 2020.

Written Opinion from corresponding PCT application No. PCT/US2020/046283, dated Nov. 5, 2020.

* cited by examiner

*Primary Examiner* — Prem C Singh
*Assistant Examiner* — Brandi M Doyle

(57) ABSTRACT

A naphtha hydrotreating process involves the use of a sulfur guard bed (SGB) with a controlled bypass which allows for control of the sulfur in the feed to a downstream processing unit. The SGB is installed on the light ends stripper bottoms stream in a naphtha hydrotreating unit.

20 Claims, 1 Drawing Sheet

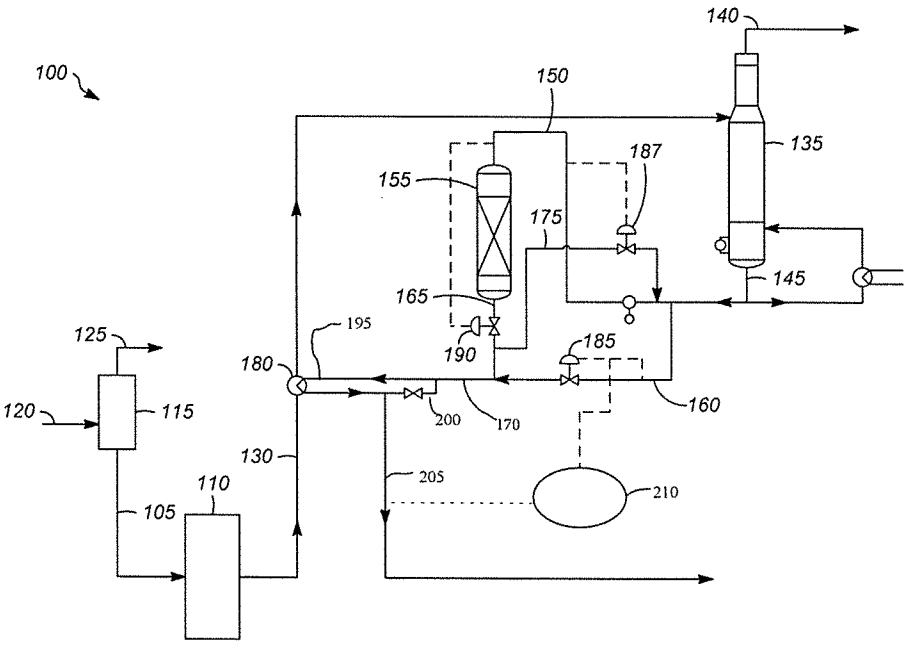
100
105
110
115
120
125
130
135
140
145
150
155
160
165
170
175
180
185
187
190
195
200
205
210

NAPHTHA HYDROTREATING PROCESS WITH SULFUR GUARD BED HAVING CONTROLLED BYPASS FLOW

BACKGROUND

When high sulfur feedstocks (typically greater than 500 wt-ppm sulfur) are fed to a naphtha hydrotreater (NHT), the typical design start of run/end of run (SOR/EOR) temperature of 315° C. to 343° C. and $H_2$:HC recycle gas ratio of less than 100 $Nm^3/m^3$ results in mercaptan formation from sulfur recombination coming from the H2S in the reactor effluent. The recombination reaction is driven by the high build-up of $H_2S$ in the reactor effluent (e.g., greater than 0.3 mol-%, or greater than 0.6 mol-% in the recycle gas) combined with the approximately 150 wt-ppm of equilibrium olefins in the reactor effluent.

In a naphtha complex (e.g., NHT and a catalytic reforming unit) processing high sulfur feeds (e.g., greater than 500 wt-ppm), a conventional NHT may not be suitable to reduce the sulfur in the stripper bottoms product below 0.5-1.0 wt-ppm specification required for the catalytic reforming unit. Also, to reduce the risk of metal catalyzed coke (MCC) formation in reforming units, sulfur injection may be provided to control the sulfur in the feed to the reforming unit at between 0.5 and 1.0 wt-ppm (depending on the severity of the reforming unit operations), so it is necessary to keep some sulfur (e.g., less than 0.5 ppm) in the NHT product One conventional method to address this issue is including a recycle gas scrubber to remove the $H_2S$ from the recycle gas. However, at a typical $H_2$:HC recycle gas ratio that would only reduce the resultant sulfur at the outlet by one third from a base recombination sulfur level can be as high as 2 wt-ppm. The amount removed can be increased by increasing the recycle gas ratio. However, this results in much higher capital costs (a large recycle gas scrubber and a larger recycle gas compressor), and increased utility costs to run the larger recycle gas compressor. Additionally, it results in higher operating costs because the caustic in the scrubber needs replacement at periodic intervals and it results in special material handling issues due to the nature of caustic. Finally, sulfur guard beds include ancillary equipment to maintain the inlet temperature between 121-177° C. (250-350° F.) for good sulfur removal.

Another possible solution is to place a sulfur guard bed (SGB) on the NHT product containing either the light or heavy or both naphtha streams. The naphtha is typically split into a light and heavy cut using a naphtha splitter distillation column upstream or downstream of the hydrotreater. The boiling range for a light naphtha typically ranges from about 29.4° C. (85° F.) 5% distillation point to about 82.2° C. (180° F.) 95% distillation point by ASTM D-2887. This boiling range encompasses the majority of the 2-methylbutane from the crude oil cut as a key component on the light end and benzene as the key component on the heavy end. Heavy naphtha will have about 180° F. 5% distillation point to up to 198.9° C. (390° F.) 95% point if the heavy naphtha is sent to a naphtha reforming unit. The 95% distillation point for the heavy naphtha is often less than 198.9° C. (390° F.), perhaps as low as 148.9° C. (300° F.) if the naphtha reformer is making gasoline. The SGB's have limited life when used to treat the either the light, heavy or entire light and heavy naphtha streams unnecessarily to much less than 0.1 wt-ppm S. Typically, sulfur adsorbent beds cannot be designed to leave a certain, finite amount of sulfur at the sulfur adsorbent bed outlet. Therefore, the only way to target an above nil quantity of sulfur in the hydrotreated naphtha stream is to bypass a certain amount of the stripped, hydrotreated naphtha stream around the sulfur guard bed, thereby increasing adsorbent life by treating less of the total stream. Because the catalytic reformer requires less than 0.5-1.0 wppm sulfur in the feed to mitigate MCC, it is desirable that not all of the NHT product is treated, but a portion of it is bypassed around the sulfur guard bed. It is challenging to set the bypass fraction setpoint based upon offline sulfur analyses of the reduced sulfur naphtha product in the stream combined from the SGB and the bypass because the error range for off-line sulfur analyses at these 0.5-1.0 wt-ppm levels can be 40%-60% of the actual sulfur content which would wildly swing the calculated fraction to bypass from sample to sample without any actual change in the sulfur content of the reduced sulfur naphtha stream occurring.

Therefore, there is a need for an improved naphtha hydrotreating process in order to maintain the desired NHT product sulfur level (e.g., less than 0.5-1.0 wppm), not remove all of the sulfur, maximize the SGB adsorbent life, and provide smooth control to the fraction of the flow that bypasses the SGB.

BRIEF DESCRIPTION OF THE DRAWING

The FIGURE illustrates one embodiment of a naphtha hydrotreating process of the present invention.

DETAILED DESCRIPTION

The present process involves the use of a sulfur guard bed (SGB) with a controlled bypass which allows for control of the sulfur in the feed to a downstream processing unit. The SGB is installed on the light ends stripper bottoms stream in a naphtha hydrotreating unit. A bypass around the SGB is provided with a control valve and a controller implemented in the distributed control system (DCS) or connected ancillary programmable logic controller, or other digital control system. The opening of the control valve may be regulated in a variety of ways, as discussed below.

For example, when the downstream processing unit is a catalytic reforming unit, the present process allows the sulfur injection to the catalytic reforming unit to be stopped or attenuated while still maintaining the recommended level of sulfur in the feed to the catalytic reforming unit and controlling the risk of MCC formation. This reduces the operating costs of the catalytic reforming unit.

The addition of the controlled bypass allows the refiner to maximize the life of the adsorbent in the SGB by processing only as much of the light ends stripper bottom stream through the SGB as is needed to achieve the desired sulfur level in the reduced sulfur naphtha product.

There can be a recycle line from the SGB effluent line to the line into the SGB. This allows the maintenance of the superficial velocity through the SGB when the unit is operated at less than 100% capacity. Maintaining the required superficial velocity is necessary for good radial flow distribution and sulfur removal performance of the SGB. There can also be a pressure differential controller or a restriction orifice downstream of the SGB to maintain the proper flow. This arrangement provides better control for the recycle control valve due to the increased pressure drop.

In addition, the size of the sulfur guard bed can be reduced compared to a configuration without a bypass, reducing capital cost and adsorbent loading costs.

When the reduced sulfur naphtha product stream is sent to a reforming unit, the bypass arrangement allows the operator to maintain 0.5 to 1.0 wt-ppm sulfur in the reduced sulfur naphtha product stream, which means less dimethyl disulfide (DMDS) needs to be injected into the reforming uniting, further reducing operating costs.

Suitable control schemes include, but are not limited to, an on-line sulfur analyzer downstream of the mixing point for the light ends stripper bottom stream through the SGB and through the bypass line, and a flow ratio controller that keeps the ratio of naphtha flowing through the SGB to the total naphtha flow at the amount needed to meet the target sulfur content in the reduced sulfur naphtha product. In some embodiments, equilibrium recombination calculations using naphtha hydrotreater reactor operating conditions are used to maximize and estimate remaining adsorbent life by prescribing SGB bypass rates to meet downstream requirements.

In some embodiments, the SGB is placed directly on the light ends stripper bottom stream to address both the heavy and light naphtha specifications in one vessel. It is expected that the heavy naphtha will need sulfur reduction in any case with high sulfur feeds as that is where the vast majority of the $C_{5+}$ range mercaptans boil. Given that the cut point between light and heavy naphtha can vary, the two streams share a significant number of co-boiling components, that there are some $C_4$ and $C_5$ mercaptans made, and that the light naphtha sulfur specification is only 0.1 wt-ppm, the SGB on the full light ends stripper bottoms stream provides protection for both streams.

Furthermore, positioning the SGB directly on the hot light ends stripper bottoms also eliminates additional heaters and temperature controllers. The minimum temperature for good sulfur treating is 121-177° C. (250-350° F.). The light ends stripper operates between 172 and 1034 kPa(g) (25 and 150 psig), which would satisfy the target operating range for the sulfur guard bed directly from the distillation column without additional heating control. Alternatively, the sulfur guard bed could be placed after the stripper feed-bottoms heat exchanger if some cooling below the bubble point is desired to avoid adding a stripper bottoms pump.

In some embodiments, the liquid recombination sulfur content can be determined using an equilibrium calculator and the hydrotreater reactor outlet temperature, hydrotreater reactor outlet pressure, the recycle gas rate, the recycle gas $H_2S$ content, recycle gas composition, the feed rate, the feed sulfur content, the calculated hydrotreater reactor outlet olefin composition, and the feed composition. Given the target product composition, how much of the product should be bypassed can be calculated in a predictive manner, and a rolling total of how much sulfur has been removed by the SBG can be kept to estimate remaining bed life. Equilibrium olefin value calculations can be calculated by one skilled in the art using process simulators, while recombination equilibrium can be calculated in similar manner using an equation as stated in Desai, P. H. et al, Fuel Reformulation, November/December 1994, 43-52.

One aspect of the invention is a naphtha hydrotreating process. In one embodiment, the process comprises; providing a naphtha stream having an organic sulfur content greater than about 500 wt-ppm; converting the organic sulfur to hydrogen sulfide in a hydrotreating reactor forming a hydrotreated stream; separating the hydrotreated naphtha stream in a light ends stripper into a light ends stripper overhead stream and a light ends stripper bottom stream, wherein the light ends stripper overhead stream comprises hydrogen sulfide, hydrogen, ammonia, and light hydrocarbons, and the light ends stripper bottom stream comprises hydrotreated naphtha; passing at least a portion of the light ends stripper bottom stream to a sulfur guard bed; providing a bypass line around the sulfur guard bed; continuously controlling a flow of the light ends stripper bottom stream through the sulfur guard bed and a flow of the light ends stripper bottom stream through the bypass line based on a desired fraction of flow through the bypass line to meet a reduced sulfur naphtha sulfur content; and combining the flow of the light ends stripper bottom stream through the sulfur guard bed and the flow of the light ends stripper bottom stream through the bypass line to form a reduced sulfur naphtha product stream with the reduced sulfur naphtha product stream sulfur content.

In some embodiments, continuously controlling the flow of the light ends stripper bottom stream comprises: determining the desired fraction of flow through the bypass line based on a target sulfur content of the reduced sulfur naphtha product stream; and adjusting the flow of the light ends stripper bottom stream through the bypass line to the desired fraction of flow.

In some embodiments, the process further comprises: measuring a sulfur content of the reduced sulfur naphtha product stream using an on-line sulfur analyzer to provide a setpoint for the desired fraction of flow through the bypass line.

In some embodiments, the process further comprises: calculating an amount of recombination sulfur in the light ends stripper bottoms stream from the hydrotreating reactor operating conditions and controlling the desired fraction of flow through the bypass line using the calculated amount of recombination sulfur and the target sulfur content of the reduced sulfur naphtha product stream.

In some embodiments, the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is the hydrogen sulfide partial pressure in bar.

In some embodiments, the process further comprises: measuring a difference between an actual sulfur content of the light ends stripper bottom stream and the calculated amount of recombination sulfur calculated from the reactor operating conditions and providing an automated alert when the difference exceeds a predetermined value.

In some embodiments, providing the naphtha stream comprises: separating a naphtha feed stream in a naphtha splitter into a naphtha splitter overhead stream and a naphtha splitter bottom stream and wherein the naphtha stream comprises the naphtha splitter bottom stream.

In some embodiments, the sulfur guard bed is downstream of a cooler on the light ends bottom stream with no pump on the light ends stripper bottom stream.

In some embodiments, the process further comprises: providing a pump on the light ends stripper bottom stream or the hydrotreated stream, the bypass line, or both.

In some embodiments, the reduced sulfur naphtha product stream is separated in a naphtha splitter into a naphtha splitter overhead stream and a naphtha splitter bottom stream.

In some embodiments, the process further comprises at least one of: passing at least a portion of the reduced sulfur naphtha product stream to a catalytic reforming unit to produce a reformate; or passing at least a portion of the reduced sulfur naphtha product stream to a light naphtha isomerization unit to produce an isomerate.

In some embodiments, the process further comprises: heat exchanging the reduced sulfur naphtha product stream with the hydrotreated stream.

Another aspect of the invention is a naphtha hydrotreating process> In one embodiment, the process comprises; providing a naphtha stream having an organic sulfur content greater than about 500 wt-ppm; converting the organic sulfur to hydrogen sulfide in a hydrotreating reactor; separating the naphtha stream in a light ends stripper into a light ends stripper overhead stream and a light ends stripper bottom stream, wherein the light ends stripper overhead stream comprises hydrogen sulfide, hydrogen, ammonia, and light hydrocarbons, and the light ends stripper bottom stream comprises hydrotreated naphtha; passing at least a portion of the light ends stripper bottom stream to a sulfur guard bed; providing a bypass line around the sulfur guard bed; continuously controlling a flow of the light ends stripper bottom stream through the sulfur guard bed and a flow of the light ends stripper bottom stream through the bypass line by determining a desired fraction of flow through the bypass line based on a target sulfur content of the reduced sulfur naphtha product stream, and adjusting the flow of the light ends stripper bottom stream through the bypass line to the desired fraction of flow; combining the flow of the light ends stripper bottom stream through the sulfur guard bed and the flow of the light ends stripper bottom stream through the bypass line to form a reduced sulfur naphtha product stream having the reduced sulfur naphtha product sulfur content.

In some embodiments, the process further comprises: measuring the sulfur content of the reduced sulfur naphtha product stream using an on-line sulfur analyzer to provide a setpoint for the desired fraction of flow through the bypass line.

In some embodiments, the process further comprises: calculating an amount of recombination sulfur in the light ends stripper bottoms from the reactor operating conditions and controlling the desired fraction of flow through the bypass line using the calculated amount of recombination sulfur and the target sulfur content of the reduced sulfur naphtha product stream.

In some embodiments, the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is the hydrogen sulfide partial pressure in bar.

In some embodiments, the process further comprises: measuring a difference between an actual sulfur content of the light ends stripper bottom stream and the calculated amount of recombination sulfur calculated from the reactor operating conditions and providing an automated alert when the difference exceeds a predetermined value.

In some embodiments, providing the naphtha stream comprises: separating a naphtha feed stream in a naphtha splitter into a naphtha splitter overhead stream and a naphtha splitter bottom stream and wherein the naphtha stream comprises the naphtha splitter bottom stream.

In some embodiments, the process further comprises: heat exchanging the reduced sulfur naphtha product stream with the hydrotreated stream.

In some embodiments, the reduced sulfur naphtha product stream is separated in a naphtha splitter into a naphtha splitter overhead stream and a naphtha splitter bottom stream.

The FIGURE illustrates one embodiment of the naphtha hydrotreating process 100. The naphtha stream 105 is sent to hydrotreating reactor 110. The naphtha stream 105 comprises heavy naphtha $C_{6+}$ hydrocarbons and typically has an organic sulfur content greater than about 500 wt-ppm, or greater than about 750 wt-ppm, or greater than about 1000 wt-ppm. The naphtha stream 105 can be any high sulfur feed stream (i.e., an organic sulfur content greater than about 500 wt-ppm).

In one embodiment, the naphtha stream 105 comes from a naphtha splitter 115. A naphtha feed stream 120 is sent to the naphtha splitter 115 where it is split into an overhead stream 125 comprising light naphtha $C_5$-benzene range boiling hydrocarbons and a bottom stream which is naphtha stream 105 (i.e., heavy naphtha $C_{6+}$ hydrocarbons). The naphtha feed stream 120 can come from a crude distillation unit or a condensate fraction unit, for example.

Naphtha stream 105 is hydrotreated in hydrotreating reactor 110. Hydrogen gas is contacted with naphtha stream 105 in the presence of suitable catalysts to convert the organic sulfur compounds into $H_2S$. Typical hydrotreating reaction conditions include a temperature of about 290° C. (550° F.) to about 455° C. (850° F.), a pressure of about 3.4 MPa (500 psig) to about 6.2 MPa (900 psig), a liquid hourly space velocity of about 0.5 $hr^{-1}$ to about 10 $hr^{-1}$, and a hydrogen rate of about 39 to about 946 $Nm^3/m^3$ oil (250-6,000 scf/bbl). Typical hydrotreating catalysts include at least one Group 8 metal, preferably iron, cobalt and nickel, and at least one Group 6 metal, preferably molybdenum and tungsten, on a high surface area support material, preferably alumina. Other typical hydrotreating catalysts include zeolitic catalysts, as well as noble metal catalysts where the noble metal is selected from palladium and platinum.

The hydrotreated naphtha stream 130 is sent to a light ends stripper 135 where it is separated into a light ends stripper overhead stream 140 and a light ends stripper bottom stream 145. The light ends stripper overhead stream 140 comprises hydrogen sulfide, hydrogen, ammonia, and C1-C4 hydrocarbons, and it may be sent to a fuel gas header as liquefied petroleum gas (LPG) or lighter material. The light ends stripper bottom stream 145 comprises hydrotreated naphtha.

The light ends stripper bottom stream 145 is split into two portions. The first portion is sent through line 150 to the SGB 155, and the second portion is sent through bypass line 160.

In the SGB, sulfur from the light ends stripper bottom stream 145 is adsorbed on an adsorbent. Suitable adsorbents include metal oxides, and mixtures of reduced metals and metal oxides supported on alumina or zeolitic materials like a barium exchanged zeolite. Typical operating conditions for the sulfur guard bed include temperatures in the range of about 121° C. to about 177° C., pressures in the range of about 1 MPa(g) to about 1.3 MPa(g) (about 10 barg to about 13 barg). The pressure is set to keep the stream in the liquid phase at whatever operating temperature is chosen.

The effluent in line 165 from the SGB 155 is combined with the portion of the light ends stripper bottom stream in the bypass line 160 forming a reduced sulfur naphtha product stream 170.

In some embodiments, a portion of the effluent from line 165 from the SGB 155 is recycled to line 150 through recycle line 175. The use of the recycle line 175 allows the superficial velocity to be maintained through the SGB to maintain a constant velocity profiles during turndown or periods of low recombination sulfur in the light ends stripper bottom stream.

In some embodiments, the SGB 155 is downstream of a cooler (typically a heat exchanger, like 180, that uses the high temperature light ends stripper bottom stream to heat the light end stripper feed stream) on the light ends stripper bottom stream 145 with no pump on the light ends stripper bottom stream 145. Alternatively, there could be a pump on the light ends stripper bottom stream 145.

In some embodiments, stream 195 which is a portion of the reduced sulfur naphtha product stream 170 is heat exchanged with hydrotreated naphtha stream 130 in heat exchanger 180. Stream 200 which is another portion of the reduced sulfur naphtha product stream 170 can bypass the heat exchanger 180, if desired. The portions 195 and 200 are then combined to form reduced sulfur naphtha product stream 205.

As illustrated in the FIGURE, the naphtha splitter 115 is upstream of the hydrotreating reactor 110. In some embodiments, the naphtha splitter 115 can be downstream of the hydrotreating reactor 110 and the SGB 155. In this case, a full boiling range naphtha 29.4° C. up to 198.9° C. (85° F. to up to 390° F., 5% and 95% distillation points, respectively), in naphtha stream 105 would be sent to the hydrotreating reactor 110. The naphtha splitter would then be on reduced sulfur naphtha product stream 205.

The flow through the SGB 155 and the bypass line 160 is continuously controlled based on a desired fraction of flow through the bypass line 160 to meet a reduced sulfur naphtha sulfur content. The flow through the line 150 and bypass line 160 can be controlled using one or more flow controllers, such as flow controller 185 on bypass line 160, and flow controller 187 on recycle line 175. One or more pressure controllers 190 can also be used, such as pressure controller 190 on the effluent in line 165 from the SGB 155. In addition, the presence of the pressure controller 190 on the line 165 provides better control for the flow controller 187 due to the higher pressure differential.

The continuous flow control can be done in a different ways. For example, the desired fraction of flow through the bypass line 160 can be determined based on a target sulfur content in the reduced sulfur naphtha product stream 205. The target will be based on the use for the reduced sulfur naphtha product stream 205. For example, if the reduced sulfur naphtha product stream 205 heavy naphtha fraction is sent to a reforming process, the hydrotreated naphtha product sulfur content will generally be less than about 0.5 wt-ppm or 1 wt-ppm, depending on the naphtha reformer operating temperature and metallurgy. If there is more sulfur in the light naphtha fraction to meet a typical light naphtha specification for an isomerization process it will generally be less than about 0.1 wt-ppm in the light naphtha fraction. The flow through the bypass line 160 is then adjusted to the desired fraction of flow by controller 210. Continuous control is any automated method of controlling the flow by adjusting the flow setpoint using online sulfur analysis or calculated recombination sulfur content based upon hydrotreater reactor operating conditions.

In some embodiments, the desired fraction of flow through the bypass line 160 is determined by measuring the sulfur content of the reduced sulfur naphtha product stream using an on-line sulfur analyzer to provide a setpoint for the desired fraction.

In other embodiments, the desired fraction of flow through the bypass line 160 is determined by calculating an amount of recombination sulfur in the light ends stripper bottoms or the hydrotreated stream from the reactor operating conditions. Hydrogen sulfide recombination with olefins is a very fast reaction in the presence of hydrotreating catalyst, so thiols should be in equilibrium with the corresponding olefin. The desired fraction of flow through the bypass line can be controlled by controller 210 using the calculated amount of recombination sulfur and the target sulfur content of the reduced sulfur naphtha product stream. In some embodiments, the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is the hydrogen sulfide partial pressure in bar. In some embodiments, there can be a process alarm based on the calculated difference between the calculated amount of recombination sulfur calculated from the rector operating conditions and the actual sulfur content of the light ends stripper bottom stream or the hydrotreated stream. An automated alert can be provided when the difference exceeds a predetermined amount to indicate that the reactor catalyst has deactivated and a temperature increase may be required.

Specific Embodiments

While the following is described in conjunction with specific embodiments, it will be understood that this description is intended to illustrate and not limit the scope of the preceding description and the appended claims.

A first embodiment of the invention is a process comprising; providing a naphtha stream having an organic sulfur content greater than about 500 wt-ppm; converting the organic sulfur to hydrogen sulfide in a hydrotreating reactor forming a hydrotreated stream; separating the hydrotreated naphtha stream in a light ends stripper into a light ends stripper overhead stream and a light ends stripper bottom stream, wherein the light ends stripper overhead stream comprises hydrogen sulfide, hydrogen, ammonia, and light hydrocarbons, and the light ends stripper bottom stream comprises hydrotreated naphtha; passing at least a portion of the light ends stripper bottom stream to a sulfur guard bed; providing a bypass line around the sulfur guard bed; continuously controlling a flow of the light ends stripper bottom stream through the sulfur guard bed and a flow of the light ends stripper bottom stream through the bypass line based on a desired fraction of flow through the bypass line to meet a reduced sulfur naphtha sulfur content; combining the flow of the light ends stripper bottom stream through the sulfur guard bed and the flow of the light ends stripper bottom stream through the bypass line to form a reduced sulfur naphtha product stream with the reduced sulfur naphtha product stream sulfur content. An embodiment of the invention is one, any or all of prior embodiments in this paragraph up through the first embodiment in this paragraph wherein continuously controlling the flow of the light ends stripper bottom stream comprises determining the desired fraction of flow through the bypass line based on a target sulfur content of the reduced sulfur naphtha product stream; and adjusting the flow of the light ends stripper bottom stream through the bypass line to the desired fraction of flow. An embodiment of the invention is one, any or all of prior embodiments in this paragraph up through the first embodiment in this paragraph further comprising measuring a sulfur content of the reduced sulfur naphtha product stream using an on-line sulfur analyzer to provide a setpoint for the desired fraction of flow through the bypass line. An embodiment of the invention is one, any or all of prior embodiments in this paragraph up through the first embodiment in this paragraph further comprising calculating an amount of recombination sulfur in the light ends stripper bottoms stream from the hydrotreating reactor operating conditions and controlling the desired fraction of flow through the bypass line using the calculated amount of recombination sulfur and the target sulfur content of the reduced sulfur naphtha product stream. An embodiment of the invention is one, any or all of prior embodiments in this paragraph up through the first embodiment in this paragraph wherein the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is hydrogen sulfide partial pressure in bar. An embodiment of the invention is one, any or all of prior embodiments in this paragraph up through the first embodiment in this paragraph further comprising measuring a difference between an actual sulfur content of the light ends stripper bottom stream and the calculated amount of recombination sulfur calculated from the reactor operating conditions and providing an automated alert when the difference exceeds a predetermined value. An embodiment of the invention is one, any or all of prior embodiments in this paragraph up through the first embodiment in this paragraph wherein providing the naphtha stream comprises separating a naphtha feed stream in a naphtha splitter into a naphtha splitter overhead stream and a naphtha splitter bottom stream and wherein the naphtha stream comprises the naphtha splitter bottom stream. An embodiment of the invention is one, any or all of prior embodiments in this paragraph up through the first embodiment in this paragraph wherein the sulfur guard bed is downstream of a cooler on the light ends bottom stream with no pump on the light ends stripper bottom stream. An embodiment of the invention is one, any or all of prior embodiments in this paragraph up through the first embodiment in this paragraph further comprising providing a pump on the light ends stripper bottom stream or the hydrotreated stream, the bypass line, or both. An embodiment of the invention is one, any or all of prior embodiments in this paragraph up through the first embodiment in this paragraph wherein the reduced sulfur naphtha product stream is separated in a naphtha splitter into a naphtha splitter overhead stream and a naphtha splitter bottom stream. An embodiment of the invention is one, any or all of prior embodiments in this paragraph up through the first embodiment in this paragraph further comprising at least one of passing at least a portion of the reduced sulfur naphtha product stream to a catalytic reforming unit to produce a reformate; passing at least a portion of the reduced sulfur naphtha product stream to a light naphtha isomerization unit to produce an isomerate. An embodiment of the invention is one, any or all of prior embodiments in this paragraph up through the first embodiment in this paragraph further comprising heat exchanging the reduced sulfur naphtha product stream with the hydrotreated stream.

A second embodiment of the invention is a process comprising; providing a naphtha stream having an organic sulfur content greater than about 500 wt-ppm; converting the organic sulfur to hydrogen sulfide in a hydrotreating reactor; separating the naphtha stream in a light ends stripper into a light ends stripper overhead stream and a light ends stripper bottom stream, wherein the light ends stripper overhead stream comprises hydrogen sulfide, hydrogen, ammonia, and light hydrocarbons, and the light ends stripper bottom stream comprises hydrotreated naphtha; passing at least a portion of the light ends stripper bottom stream to a sulfur guard bed; providing a bypass line around the sulfur guard bed; continuously controlling a flow of the light ends stripper bottom stream through the sulfur guard bed and a flow of the light ends stripper bottom stream through the bypass line by determining a desired fraction of flow through the bypass line based on a target sulfur content of the reduced sulfur naphtha product stream, and adjusting the flow of the light ends stripper bottom stream through the bypass line to the desired fraction of flow; combining the flow of the light ends stripper bottom stream through the sulfur guard bed and the flow of the light ends stripper bottom stream through the bypass line to form a reduced sulfur naphtha product stream having the reduced sulfur naphtha product sulfur content. An embodiment of the invention is one, any or all of prior embodiments in this paragraph up through the second embodiment in this paragraph further comprising measuring the sulfur content of the reduced sulfur naphtha product stream using an on-line sulfur analyzer to provide a setpoint for the desired fraction of flow through the bypass line. An embodiment of the invention is one, any or all of prior embodiments in this paragraph up through the second embodiment in this paragraph further comprising calculating an amount of recombination sulfur in the light ends stripper bottoms from the reactor operating conditions and controlling the desired fraction of flow through the bypass line using the calculated amount of recombination sulfur and the target sulfur content of the reduced sulfur naphtha product stream. An embodiment of the invention is one, any or all of prior embodiments in this paragraph up through the second embodiment in this paragraph wherein the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is hydrogen sulfide partial pressure in bar. An embodiment of the invention is one, any or all of prior embodiments in this paragraph up through the second embodiment in this paragraph further comprising measuring a difference between an actual sulfur content of the light ends stripper bottom stream and the calculated amount of recombination sulfur calculated from the reactor operating conditions and providing an automated alert when the difference exceeds a predetermined value. An embodiment of the invention is one, any or all of prior embodiments in this paragraph up through the second embodiment in this paragraph wherein providing the naphtha stream comprises separating a naphtha feed stream in a naphtha splitter into a naphtha splitter overhead stream and a naphtha splitter bottom stream and wherein the naphtha stream comprises the naphtha splitter bottom stream. An embodiment of the invention is one, any or all of prior embodiments in this paragraph up through the second embodiment in this paragraph further comprising heat exchanging the reduced sulfur naphtha product stream with the hydrotreated stream. An embodiment of the invention is one, any or all of prior embodiments in this paragraph up through the second embodiment in this paragraph wherein the reduced sulfur naphtha product stream is separated in a naphtha splitter into a naphtha splitter overhead stream and a naphtha splitter bottom stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A naphtha hydrotreating process comprising;

providing a naphtha stream having an organic sulfur content greater than about 500 wt-ppm;

converting the organic sulfur to hydrogen sulfide in a hydrotreating reactor forming a hydrotreated stream;

separating the hydrotreated naphtha stream in a light ends stripper into a light ends stripper overhead stream and a light ends stripper bottom stream, wherein the light ends stripper overhead stream comprises hydrogen sulfide, hydrogen, ammonia, and light hydrocarbons, and the light ends stripper bottom stream comprises hydrotreated naphtha;

passing a portion of the light ends stripper bottom stream to a sulfur guard bed;

providing a bypass line around the sulfur guard bed;

continuously controlling a flow of the light ends stripper bottom stream through the sulfur guard bed and a flow of the light ends stripper bottom stream through the bypass line based on a desired fraction of flow through the bypass line to meet a reduced sulfur naphtha sulfur content;

combining the flow of the light ends stripper bottom stream through the sulfur guard bed and the flow of the light ends stripper bottom stream through the bypass line to form a reduced sulfur naphtha product stream with the reduced sulfur naphtha product stream sulfur content.

2. The process of claim 1 wherein continuously controlling the flow of the light ends stripper bottom stream comprises:

determining the desired fraction of flow through the bypass line based on a target sulfur content of the reduced sulfur naphtha product stream; and adjusting the flow of the light ends stripper bottom stream through the bypass line to the desired fraction of flow.

3. The process of claim 2 further comprising:

measuring a sulfur content of the reduced sulfur naphtha product stream using an on-line sulfur analyzer to provide a setpoint for the desired fraction of flow through the bypass line.

4. The process of claim 2 further comprising:

calculating an amount of recombination sulfur in the light ends stripper bottoms stream from the hydrotreating reactor operating conditions and controlling the desired fraction of flow through the bypass line using the calculated amount of recombination sulfur and the target sulfur content of the reduced sulfur naphtha product stream.

5. The process of claim 4 wherein the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is the hydrogen sulfide partial pressure in bar.

6. The process of claim 5 further comprising:

measuring a difference between an actual sulfur content of the light ends stripper bottom stream and the calculated amount of recombination sulfur calculated from the reactor operating conditions and providing an automated alert when the difference exceeds a predetermined value.

7. The process of claim 1 wherein providing the naphtha stream comprises:

separating a naphtha feed stream in a naphtha splitter into a naphtha splitter overhead stream and a naphtha splitter bottom stream and wherein the naphtha stream comprises the naphtha splitter bottom stream.

8. The process of claim 1 wherein the sulfur guard bed is downstream of a cooler on the light ends bottom stream with no pump on the light ends stripper bottom stream.

9. The process of claim 1 further comprising:

providing a pump on the light ends stripper bottom stream or the hydrotreated stream, the bypass line, or both.

10. The process of claim 1 wherein the reduced sulfur naphtha product stream is separated in a naphtha splitter into a naphtha splitter overhead stream and a naphtha splitter bottom stream.

11. The process of claim 1 further comprising at least one of:

passing at least a portion of the reduced sulfur naphtha product stream to a catalytic reforming unit to produce a reformate;

passing at least a portion of the reduced sulfur naphtha product stream to a light naphtha isomerization unit to produce an isomerate.

12. The process of claim 1 further comprising:

heat exchanging the reduced sulfur naphtha product stream with the hydrotreated stream.

13. A naphtha hydrotreating process comprising;

providing a naphtha stream having an organic sulfur content greater than about 500 wt-ppm;

converting the organic sulfur to hydrogen sulfide in a hydrotreating reactor;

separating the naphtha stream in a light ends stripper into a light ends stripper overhead stream and a light ends stripper bottom stream, wherein the light ends stripper overhead stream comprises hydrogen sulfide, hydrogen, ammonia, and light hydrocarbons, and the light ends stripper bottom stream comprises hydrotreated naphtha;

passing a portion of the light ends stripper bottom stream to a sulfur guard bed;

providing a bypass line around the sulfur guard bed;

continuously controlling a flow of the light ends stripper bottom stream through the sulfur guard bed and a flow of the light ends stripper bottom stream through the bypass line by determining a desired fraction of flow through the bypass line based on a target sulfur content of the reduced sulfur naphtha product stream, and adjusting the flow of the light ends stripper bottom stream through the bypass line to the desired fraction of flow;

combining the flow of the light ends stripper bottom stream through the sulfur guard bed and the flow of the light ends stripper bottom stream through the bypass line to form a reduced sulfur naphtha product stream having the reduced sulfur naphtha product sulfur content.

14. The process of claim 13 further comprising:

measuring the sulfur content of the reduced sulfur naphtha product stream using an on-line sulfur analyzer to provide a setpoint for the desired fraction of flow through the bypass line.

15. The process of claim 13 further comprising:

calculating an amount of recombination sulfur in the light ends stripper bottoms from the reactor operating conditions and controlling the desired fraction of flow through the bypass line using the calculated amount of recombination sulfur and the target sulfur content of the reduced sulfur naphtha product stream.

16. The process of claim 15 wherein the amount of recombination sulfur is calculated according to the equation:

$$\text{Recombination Sulfur (ppm)} = w_{olefins}\, e^{(7170/T-3.5)} p_{H2S}$$

where $w_{olefins}$ is the weight fraction of olefins, T is the temperature in ° C., $p_{H2S}$ is the hydrogen sulfide partial pressure in bar.

17. The process of claim 16 further comprising:

measuring a difference between an actual sulfur content of the light ends stripper bottom stream and the calculated amount of recombination sulfur calculated from the reactor operating conditions and providing an automated alert when the difference exceeds a predetermined value.

18. The process of claim 13 wherein providing the naphtha stream comprises:

separating a naphtha feed stream in a naphtha splitter into a naphtha splitter overhead stream and a naphtha splitter bottom stream and wherein the naphtha stream comprises the naphtha splitter bottom stream.

19. The process of claim 13 further comprising:

heat exchanging the reduced sulfur naphtha product stream with the hydrotreated stream.

20. The process of claim 13 wherein the reduced sulfur naphtha product stream is separated in a naphtha splitter into a naphtha splitter overhead stream and a naphtha splitter bottom stream.

* * * * *